United States Patent [19]

LeBaron

[11] 4,421,627

[45] Dec. 20, 1983

[54] ARTICLE HOLDER FOR ELECTROPLATING PROCESS

[75] Inventor: Marc LeBaron, Lincoln, Nebr.

[73] Assignee: Lincoln Plating Company, Lincoln, Nebr.

[21] Appl. No.: 381,410

[22] Filed: May 24, 1982

[51] Int. Cl.[3] ..... C25D 17/08

[52] U.S. Cl. ..... 204/297 W

[58] Field of Search ..... 204/297 W

[56] References Cited

U.S. PATENT DOCUMENTS

| | | | |
|---|---|---|---|
| 2,115,616 | 4/1938 | Brown | 204/297 W |
| 3,540,992 | 11/1970 | Belke | 204/297 W |
| 3,941,674 | 3/1976 | Vanmunster | 204/212 |
| 3,972,785 | 8/1976 | Palisin | 204/297 W |
| 3,972,798 | 8/1976 | Palisin | 204/297 W |
| 4,325,799 | 4/1982 | Gordy | 204/297 W |

*Primary Examiner*—John F. Niebling

*Attorney, Agent, or Firm*—Kokjer, Kircher, Bradley, Wharton, Bowman & Johnson

[57] ABSTRACT

An article holder in the form of a hanger bar on which are arranged an echelon pattern of a plurality of vertically spaced tubes for receiving a stem-like portion of an article. The tubes are inclined and open to entry and exit of electroplating fluid to and from the interior at both ends. The tubes include electrical conductors for applying potential to the article through contact with the stem portion so that the exposed portions of the articles outside the tube will be electroplated.

8 Claims, 3 Drawing Figures

20
13
14
16
17
18a
3.
3.
17
15
10
18
19
19a
18b 10
15a
16a
17a
16
14
17
18a
18
13

11
10
12
15
14
16
16a
17a
18
13
13a
13b
2.
2.

ARTICLE HOLDER FOR ELECTROPLATING PROCESS

BACKGROUND AND SUMMARY OF THE INVENTION

This invention lies generally in the field of electroplating and deals more particularly with means for supporting items to be only partially plated, such as combustion engine valves and the like, for travel through the electroplating process.

It is the practice in manufacturing valves for combustion engines to surface coat the valve seat and face of the valve with a special coating. This has conventionally been done by electroplating. However, because the electro-deposition of the coating material is to be confined only to a limited portion of the valve surface (no deposits are to be made on the stem) it has heretofore been felt necessary to seal off the stem portion of the valve from contact with the electroplating bath, either by wrapping, coating or by special equipment which shields the stem during its immersion in the bath. As a consequence, problems in achieving a high rate of production in electroplating valves have long been encountered.

The article holder of the present invention has features which improve markedly both ease of handling and the rate of production.

My invention provides an article holder which comprises a series of open ended tubes arranged on a hanger bar in echelon fashion with the tubes inclined at an acute angle from the vertical. The valves can be inserted stem first into the upper ends of the tube with the lower ends of the valve stems seating in conductive sleeves located within the tubes. The tubes are open to flow both at the upper and lower ends and means are provided for electrically connecting the hanger bar with the sleeves. Despite the permitted presence of electroplating bath liquid within the tube in my arrangement, there is no deposit of material on the stems and the tubes are free from contamination as they move from bath to bath during the electroplating process. The bars can be rapidly loaded and unloaded with the articles to be held. The equipment is simple and easy to maintain and greatly enhances production of electroplated valves, although it is readily adaptable to other items having the same general requirements of partial plating.

Other and further features of the invention, together with the features of novelty appurtenant thereto, will appear in the course of the following description.

DETAILED DESCRIPTION OF THE INVENTION

In the accompanying drawings, which form a part of the specification and are to be read in conjunction therewith, and in which like reference numerals indicate like parts in various views.

Figure 2:
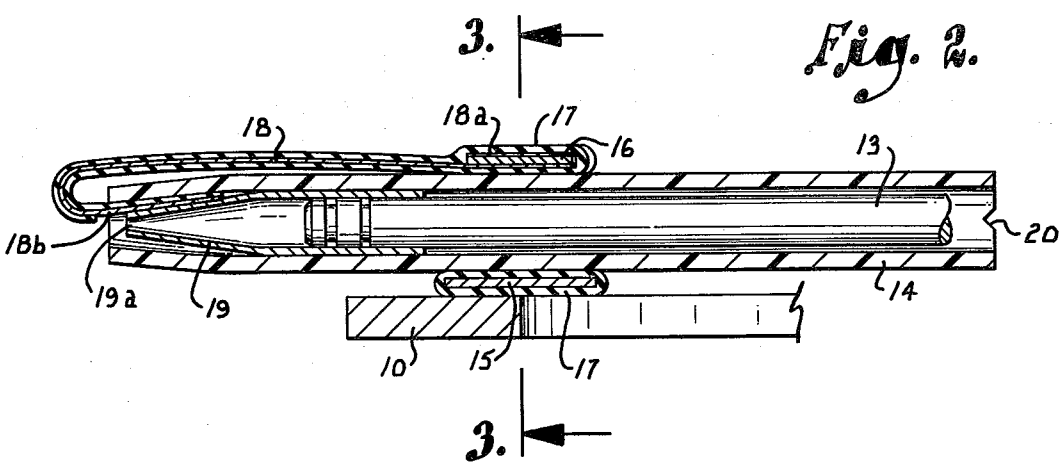
FIG. 2 is a sectional view, on an enlarged scale, taken along line 2—2 of FIG. 1 in the direction of the arrows, only a fragmentary portion of the valve being shown and part of the stem broken away for purposes of illustration.
Figure 3:
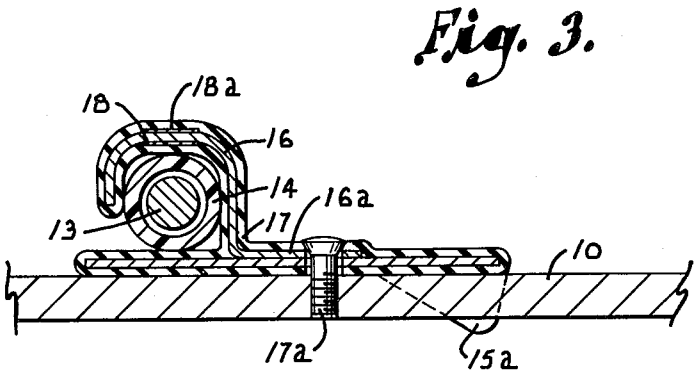
FIG. 3 is a sectional view taken along line 3—3 of FIG. 2 in the direction of the arrows.

A conventional hanger bar for use in suspending articles to be electroplated in an electroplating bath (not shown) is indicated at reference numeral 10. The hanger bar has at its upper end a generally U-shaped hanger bracket 11 which is adapted to be placed over a cathode bus bar (not shown) of the type utilized in commercial electroplating operations. The hanger bar serves to suspend the articles to be plated in the plating and cleaning tanks. In large plating operations the hanger bars are carried by conveyors which move the articles successively through conveyor tanks which contain cleaning, pickling and plating solutions with intermediate rinses.

Figure 1:
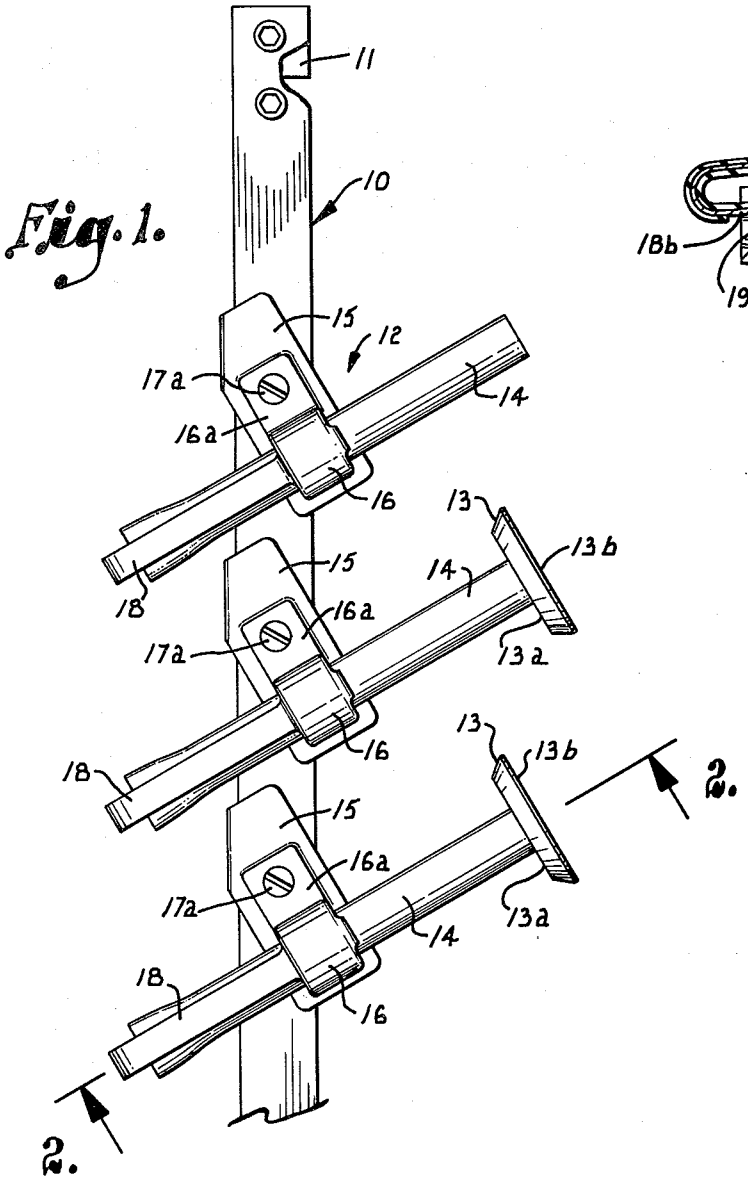
FIG. 1 is a front elevational view of a fragmentary portion of a hanger bar fitted with article holders and embodying the preferred form of the invention.

The hanger bar is made of electrically conductive material. The article holders are indicated generally at 12. The holders are mounted at spaced intervals along the hanger bar. FIG. 1 shows the upper holder 12 empty, while the lower two illustrated holders contain valves 13 which are intended to be plated. However, the plating is only to be applied to the valve seating surfaces 13*a* and concave valve face 13*b*.

Each holder comprises a hollow tube 14 into which the stem of the valve is to be inserted from the upper end. The tube is composed of a dielectric material, which may be polyvinyl chloride or any other material, such as a ceramic, that has good electrical insulating properties and is chemically inert to the plating, cleaning and rinse solutions.

The tube is supported by a clamp bracket which includes the base member 15 and an overlying arcuate clamping arm 16 which extends partially around the periphery of the tube. The base member 15 may be of any strong material, such as steel. The clamping arm 16 is made of electrically conductive material, such as a copper alloy having relatively good stiffness. The arm 16 is attached to base 15 by an extension 16*a* which overlies and is firmly attached to the base 15 as, for example, by welding.

The non-contacting surfaces of the base 15 and arm 16 are coated with an electrically non-conductive material 17 such as, for example, polyethylene, polyvinyl chloride or other suitable plastic. As seen in FIG. 2, the tube is clamped in place between coated surfaces of the base and arm.

It is an important part of the invention that the tube be inclined at an angle between the vertical and horizontal. We prefer the 45 degree angle illustrated in the drawing. The reasons for this will be explained hereinafter.

The base member 15 is attached to the hanger bar by means of an attaching screw 17*a* which extends through registering apertures in the base 15 and the arm extension 16*a*. The external diameter of the screw head and its configuration are such as to make good electrical contact with the inside extension 16*a*. The screw is also formed of electrically conductive material so that a conductive path is established from the hanger bar through the screw to the arm extension 16*a* and into the arm. The exposed surface of the head of the screw is coated with a non-conductive material, such as the plastics earlier mentioned. Proper orientation of the hanger bracket and maintenance of the proper position on the arm is achieved through the use of a bent corner on the base member 15 which provides a locating flange 15*a*. The flange engages the side edge of the bar 10 and in cooperation with the screw serves to maintain the holder in its proper orientation.

An electrical conductor 18 in the form of a strip of insulation coated, electrically conductive metal extends from the arm 16 toward the bottom end of the tube and is reversely bent to extend back up inside the tube through the open lower end. One end of the strip 18 is attached to the arm 16. The attachment can be by spot welding or otherwise. In the illustrated embodiment, a portion 18*a* of the strip is folded back over the arm and attachment is made by spot welding the laminated portions. As in the case of the arm and base member 15, the strip 18 also is coated through the major portion of its length with the non-conductive plastic coating. However, a portion of the upturned part of the strip which extends into the tube is uncoated.

The uncoated portion 18*b* of the strip makes electrical contact with one end of a conductive sleeve 19 (preferably of stainless steel) which is fitted within the lower end of the tube. The sleeve is initially fully cylindrical. However in the manufacturing process, the sleeve is crimped or flattened at the lower end. It is not flattened completely closed, but an opening 19*a* is provided to permit circulation of a liquid into the tube. In manufacturing the strip 18, the reversely bent portion is normally at a greater angle with the main portion of the strip than is depicted in FIG. 2. During assembly, when the strip portion 18*b* is fitted into and between the wall of the tube and the wall of the sleeve, it is resiliently flexed so as to establish good electrical surface contact between the uncoated surface of the extension and the outer wall of the sleeve.

The interior diameter of the stainless steel tube is made to fit as closely as possible with the lower end of the valve stem, so as to assure of good contact. The plastic tubing of which tube 14 is formed is sized as to accommodate the crimping of the lower end of the sleeve, and still allow the sleeve to be inserted into the plastic tube.

The circular upper portion of the sleeve 19 is intended to receive the lower end of a valve stem which is inserted into the tube as shown in FIG. 1. The valve is inserted until the lower surface of the valve head strikes and rests against the upper end of the tube 14. It will be noted from FIG. 2 that notches 20 are cut in the upper edge of the tube so as to permit the flow of liquid into the interior of the tube. Stated otherwise, it is not the desire in my invention to seal the tube closed from egress or entrance of the electroplating bath from or into the tube. Instead both the lower end and upper end are so constructed that liquid can freely enter or leave.

I have found that by providing such an arrangement the deposit of plating material occurs only on the surfaces to be plated, which are the surfaces exposed at and beyond the upper end of the tube. This occurs despite the fact that the electroplating bath is free to flow into the tube from either end. No deposit occurs on the stem or any of the portions of the valve within the tube. I have noticed some small collection of materials, if any deposits are made at all, on the flattened end of the sleeve but the amount has been minimal and can easily be removed. None apparently is attracted to the inserted end of the valve stem or along the stem itself.

The inclined orientation of the holder serves several valuable purposes. First, it permits a loading of the hanger bar with many more valves than could be if the holders were vertical or in some other orientation. It also permits easy loading of the bar. The valves merely need be inserted from the upper end and they will, by gravity assist, move naturally into the position in which they will be inserted in to the electroplating baths. They are likewise easily removed at the end of the process. The inclined arrangement of the tubes and the open flow which is possible through the tube and out the lower end insures that there will be no collection of liquids within the tube. In other words, when the bar is withdrawn from a given bath, the liquids which have entered the tube will drain from the tube freely and there will be no contamination as the bars moves from bath to bath.

I have found that productivity in the electroplating of combustion engine valve heads is greatly increased by my invention. The hanger bars can be rapidly loaded and no special procedures are required, nor does any concern need be had with whether or not the interiors of the tubes are completely sealed against entrance of the electroplating bath liquid. For the reasons earlier noted the electroplate deposit is confined to the head portion of the valve, i.e., that portion located outside the tube, and no deposits occur on the stem itself. The arrangement of the stems on the bar in echelon fashion permits a large number of holders per bar which in turn increases the rate of production per unit of time.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. Apparatus for use in an electroplating bath, comprising:

an electrically conductive hanger bar for immersion in the bath and having a major lengthwise upright axis;

a plurality of article holders secured to said hanger bar and spaced at intervals along said bar;

each said article holder comprising an electrically non-conductive hollow tube open at both ends and having a tube axis;

each said tube arranged so that the tube axis is oriented at an acute angle with respect to the bar axis thus to define an upper and lower end for each tube;

an electrical connector extending between said bar and into the inside lower end of each tube through the open lower end, said connector covered against contact with the bath except inside the tube;

said tube adapted to receive through its upper end a stem of an article to be electroplated with the stem in electrical contact with the connector inside the tube; and means providing access to the interior of the tube by the bath liquid through the upper and lower ends of said tubes.

2. Apparatus as in claim 1, wherein said last named means at the upper end of the tube comprises notches in the end edge of the tube.

3. Apparatus as in claim 1, including an electrically conductive cylindrical sleeve located within the bottom portion of said tube;

said sleeve adapted to receive said stem, said connector making electrical contact with the exterior of said sleeve.

4. Apparatus as in claim 3, wherein the lower portion of said sleeve is flattened to provide an elongate opening as compared with the cylindrical opening at the upper end of said sleeve.

5. Apparatus as in claim 1, said article holder including a bracket holding said tube, said bracket including a base member fastened to said bar by a single screw, the base member including a flange member engaging a side edge of said bar for cooperating with said screw in preventing angular movement of said tube relative to said bar.

6. Apparatus for use in an electroplating bath, comprising:

an electrically conductive hanger bar for immersion in the bath and having a major lengthwise upright axis;

a plurality of article holders secured to said hanger bar and spaced at intervals along the length of said bar;

each said article holder comprising an electrically non-conductive hollow tube open at both ends and having a tube axis;

each said tube arranged so that the tube axis is oriented at an acute angle with respect to the bar axis thus to define an upper and lower end for each tube;

means establishing an electrically conductive connection between the hanger bar and the interior of the lower end of each tube;

said tube adapted to receive through its upper end the stem of an article to be electroplated with the stem end in electric contact with said last named means;

said tube open to flow of bath liquid into and from said tube through both said upper and lower ends while said article is inserted therein.

7. Apparatus as in claim 6, wherein, each said article holder includes a base member and an arm member attached thereto, said tube being gripped between said base member and said arm member, said base member being attached to said bar.

8. Apparatus as in claim 6, said arm member comprising electrically conductive material;

means connecting said arm member electrically with said bar; and electrically conductive means extending from said arm along the exterior of said tube and reversely bent to enter the interior of the tube through the open lower end.

* * * * *